US008678628B2

(12) United States Patent
Futami

(10) Patent No.: US 8,678,628 B2
(45) Date of Patent: Mar. 25, 2014

(54) PROJECTION LENS FOR A VEHICLE LIGHT

(75) Inventor: Takashi Futami, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 227 days.

(21) Appl. No.: 13/357,608

(22) Filed: Jan. 24, 2012

(65) Prior Publication Data

US 2012/0188781 A1 Jul. 26, 2012

(30) Foreign Application Priority Data

Jan. 24, 2011 (JP) ..... 2011-012297

(51) Int. Cl.
*F21V 5/00* (2006.01)
*F21V 5/04* (2006.01)

(52) U.S. Cl.
USPC ..... 362/522; 362/520; 362/268; 362/333; 362/334; 362/338

(58) Field of Classification Search
USPC ..... 362/520–522, 326–340, 362/311.01–311.15, 539, 268
See application file for complete search history.

(56) References Cited

U.S. PATENT DOCUMENTS

| | | | | |
|---|---|---|---|---|
| 7,997,779 | B2 * | 8/2011 | Futami | 362/539 |
| 8,042,981 | B2 * | 10/2011 | Kotajima et al. | 362/538 |
| 8,545,058 | B2 * | 10/2013 | Chen et al. | 362/268 |
| 2006/0239022 | A1 | 10/2006 | Inaba et al. | |
| 2010/0165652 | A1 * | 7/2010 | Ookubo | 362/522 |

FOREIGN PATENT DOCUMENTS

JP 2006-302711 A 11/2006

* cited by examiner

*Primary Examiner* — Robert May
(74) *Attorney, Agent, or Firm* — Kenealy Vaidya LLP

(57) ABSTRACT

A vehicle light using a projection lens of a novel appearance can provide a feeling of solidness as compared to a simple spherical shape. The vehicle light can include a projection lens having an optical axis and a plurality of separate lens portions divided in a radial pattern with respect to the optical axis of the projection lens. The separate lens portions can have respective light exiting surfaces of different curvatures, and respective light incident surfaces, the shapes of which are determined such that the separate lens portions have the same thickness and the same focal point.

8 Claims, 12 Drawing Sheets

20
21
21
21
30
30
30
22
A
A
A
40
41
42
42

21
30
22
40
A
42
41
40
42

PROJECTION LENS FOR A VEHICLE LIGHT

This application claims the priority benefit under 35 U.S.C. §119 of Japanese Patent Application No. 2011-012297 filed on Jan. 24, 2011, which is hereby incorporated in its entirety by reference.

TECHNICAL FIELD

The presently disclosed subject matter relates to a vehicle light, and more specifically, to a vehicle light using a projection lens of a novel appearance providing a feeling of solidness different from that of a conventional projection lens of a simple spherical shape.

BACKGROUND ART

A vehicle light 200 shown in FIG. 1 using a spherical or aspherical projection lens 210 (image forming lens) is known as one of the conventional vehicle lights (see Japanese Patent Application Laid-Open No. 2006-302711, for example).

The aforementioned conventional projection lens 210 has a simple spherical shape. Accordingly, the vehicle light 200 may not be differentiated in design from other vehicle lights if it is formed by using the conventional projection lens 210.

SUMMARY

The presently disclosed subject matter was devised in view of these and other problems and features and in association with the conventional art. According to an aspect of the presently disclosed subject matter, a vehicle light can be provided with a projection lens of a novel appearance providing a feeling of solidness different from a conventional projection lens of a simple spherical shape.

According to another aspect of the presently disclosed subject matter, a vehicle light can include a projection lens having an optical axis and including: a plurality of separate lens portions divided in a radial pattern with respect to the optical axis of the projection lens. The separate lens portions can have respective light exiting surfaces of different curvatures, and respective light incident surfaces shapes of which are determined such that the separate lens portions have the same thickness and the same focal point.

With the above configuration, it is possible to provide a vehicle light which uses a projection lens with level differences between the light exiting surfaces and between the light incident surfaces as a result of different curvatures, and which has a novel appearance providing a feeling of solidness completely different from that of a conventional projection lens of a simple spherical shape. The projection lens has a single focal point while it is formed by combining the plurality of lens portions. Accordingly, this projection lens can be treated in the same manner as generally used spherical or aspherical lenses.

According to still another aspect of the presently disclosed subject matter, a vehicle light can include a cylindrical lens having an optical axis. The cylindrical lens can include a plurality of separate cylindrical lens portions divided in a radial pattern with respect to the optical axis of the cylindrical lens. The separate cylindrical lens portions can have respective light exiting surfaces of different curvatures, and respective light incident surfaces the shapes of which are determined such that the separate cylindrical lens portions have the same thickness and the same focal line.

With this configuration, it is possible to provide a vehicle light which uses a cylindrical lens with level differences between the light exiting surfaces and between the light incident surfaces as a result of different curvatures, and which has a novel appearance providing a feeling of solidness completely different from that of a conventional projection lens of a simple spherical shape. The cylindrical lens can have a single focal line while it is formed by combining the plurality of cylindrical lens portions. Accordingly, this cylindrical lens can be treated in the same manner as generally used cylindrical lenses.

In the vehicle light with the cylindrical lens described above, the cylindrical lens can include a first lens portion disposed at one end of the cylindrical lens extending along the cylindrical axis of the cylindrical lens, and a second lens portion disposed at the opposite end of the cylindrical lens extending along the cylindrical axis.

With this configuration, it is possible to cause the first and second lens portions to control rays of light to travel toward the opposite ends of the cylindrical lens extending in the direction of the cylindrical axis of the cylindrical lens.

In the vehicle light with the cylindrical lens described above, the first and second lens portions can correspond to two lens portions obtained by dividing a lens portion in the form of a quadrangle in front view cut out of a spherical convex lens into two with respect to the optical axis of the cut out lens portion.

With this configuration, it is possible to cause the first and second lens portions to control rays of light to travel toward the opposite ends of the cylindrical lens extending in the direction of the cylindrical axis thereof.

The vehicle light with the projection lens or cylindrical lens described above can further include a reflection surface intended to veil an inner structure, and provided on the same side as the light incident surface of the lens and in a region that does not make the reflection surface interfere with light to enter the lens.

With this configuration, it is possible to achieve a novel appearance providing a feeling of solidness, as the reflection surface is recognized in a magnified manner through the lens (projection lens or cylindrical lens).

The presently disclosed subject matter can provide a vehicle light using a projection lens of a novel appearance providing a feeling of solidness different from that of a conventional spherical projection lens.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

First Exemplary Embodiment

A vehicle light of a first exemplary embodiment made in accordance with principles of the presently disclosed subject matter will be described below with reference to the accompanying drawings.

Figure 1:
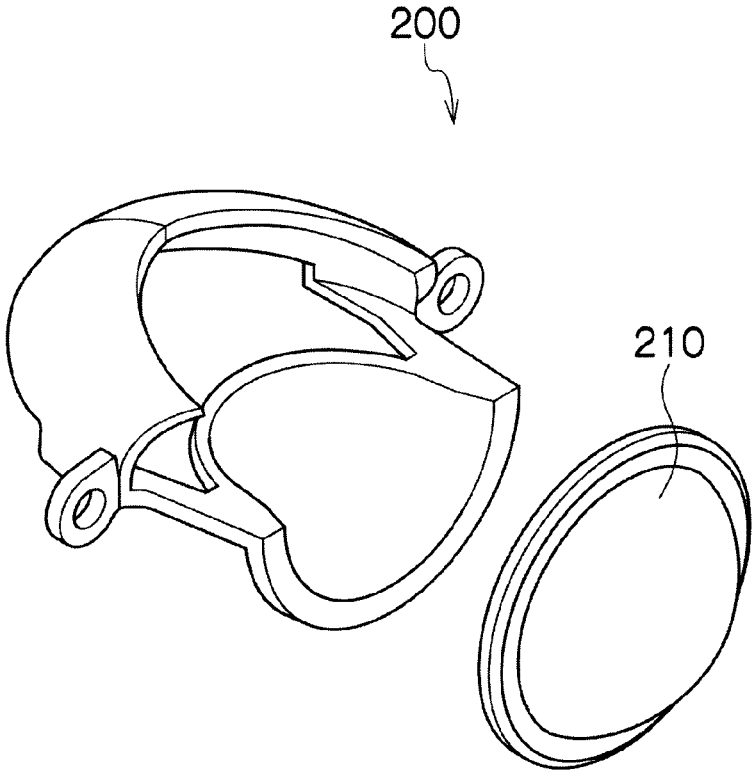
Fig. 1 Conventional Art
FIG. 1 is a perspective view of a conventional vehicle light.
Figure 2:
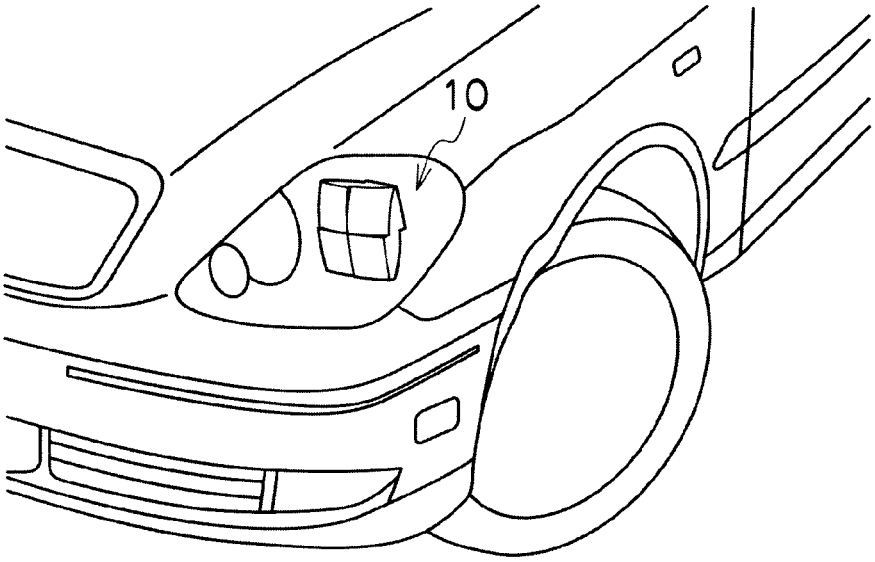
FIG. 2 is an enlarged perspective view of a vehicle on which a vehicle light (formed as a headlamp) of a first exemplary embodiment made in accordance with principles of the presently disclosed subject matter is mounted.
Figure 3:
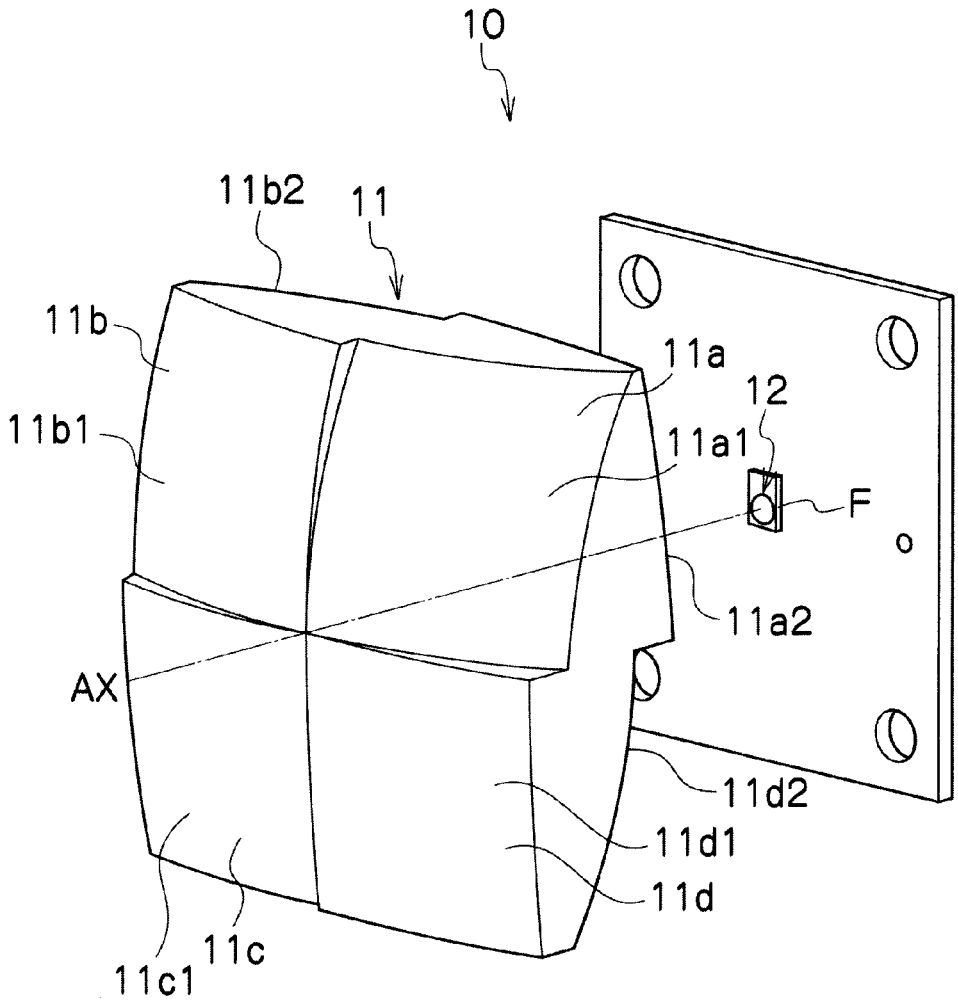
FIG. 3 is a perspective view of the vehicle light (formed as a headlamp)

A vehicle light 10 of the first exemplary embodiment can be a headlamp that can be disposed at each of right and left sides of the front end of a vehicle body as shown in FIG. 2. The headlamp 10 on the right side and the headlamp 10 on the left side arranged in a symmetric manner can have the same structure. Accordingly, the description given below is directed mainly to the headlamp 10 on the left side. FIG. 3 is a perspective view of the headlamp 10 arranged on the left side.

As shown in FIG. 3, the vehicle light 10 of the first exemplary embodiment can include a projection lens 11, a light source 12, as well as other structures.

Projection Lens 11

The projection lens 11 can be made of a transparent resin such as an acrylic resin or glass. As shown in FIG. 3, the projection lens 11 can include four lens portions 11*a* to 11*d* divided in a radial pattern with respect to an optical axis AX of the projection lens 11. The lens portions 11*a* to 11*d* can have light exiting surfaces 11*a*1 to 11*d*1 having different curvatures. The lens portions 11*a* to 11*d* can also have light incident surfaces 11*a*2 to 11*d*2 the shapes of which are determined such that the lens portions 11*a* to 11*d* have the same focal point.

Figure 4:
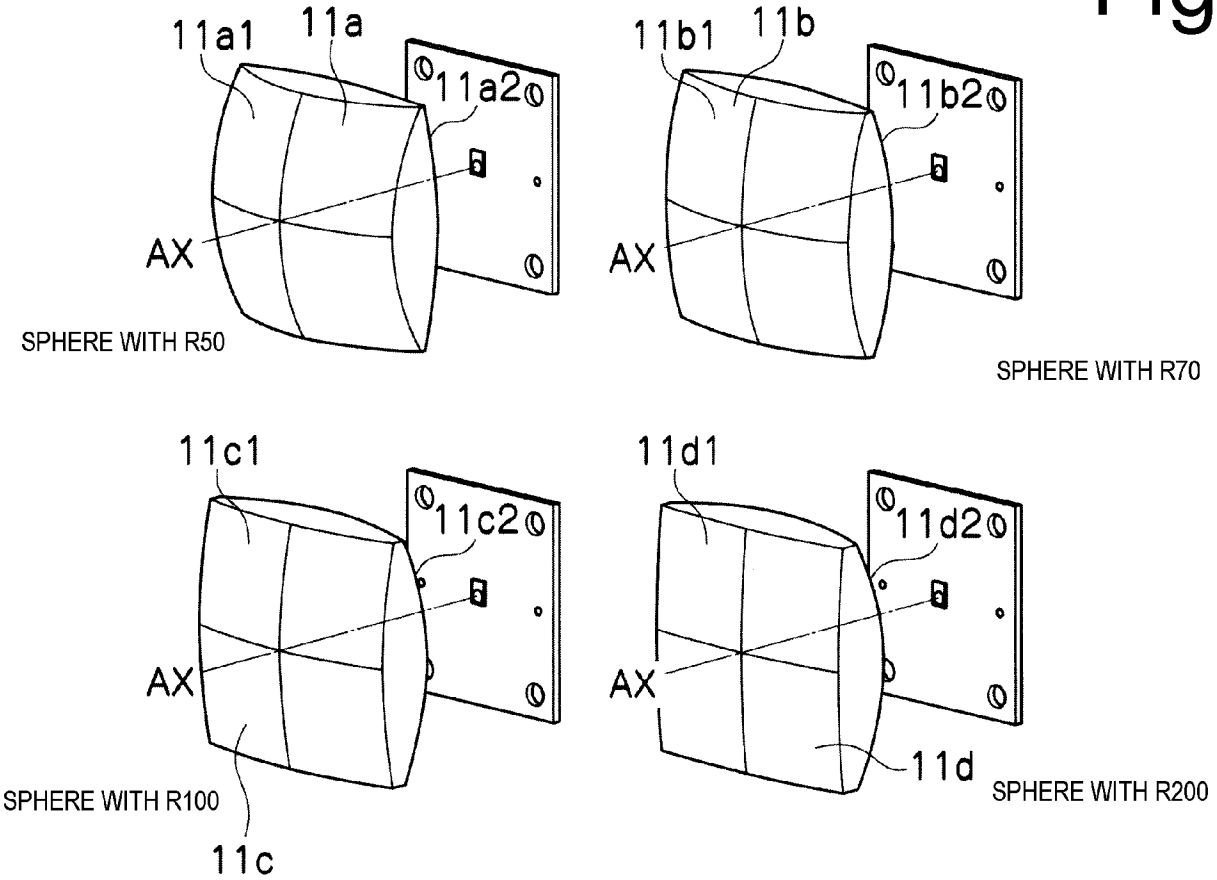
FIG. 4 shows four exemplary lenses having light exiting surfaces of different curvatures (expressed as R50, R70, R100 and R200, for example), and light incident surfaces the shapes of which are determined such that the four lenses have the same thickness and the same focal point (lenses cut out to be shaped into quadrangles in front view)

The projection lens 11 may be formed in the following exemplary manner. As shown in FIG. 4, four lenses can be prepared that have light exiting surfaces 11*a*1 to 11*d*1 of different curvatures (expressed as R50, R70, R100 and R200, for example), and light incident surfaces 11*a*2 to 11*d*2 can have shapes that are determined such that the four lenses have the same thickness and the same focal point. Then, four lens portions 11*a* to 11*d* can be cut out of the four lenses with respect to respective optical axes AX of the lenses to be shaped into quadrangles in front view, and the cut out lens portions 11*a* to 11*d* are combined, thereby forming the projection lens 11.

Figure 5:
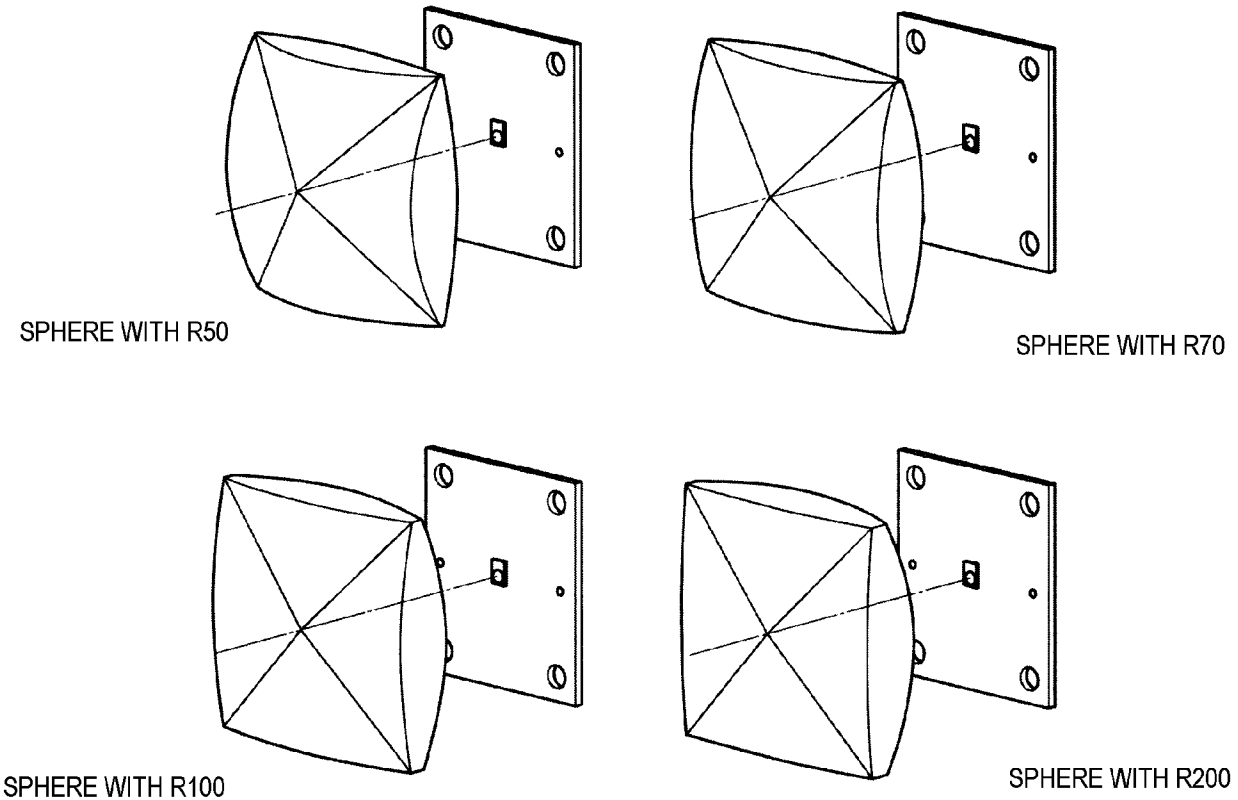
FIG. 5 shows exemplary four lenses having light exiting surfaces of different curvatures (expressed as R50, R70, R100 and R200, for example), and light incident surfaces the shapes of which are determined such that the four lenses have the same thickness and the same focal point (lenses cut out to be shaped into triangles in front view)

The number of lens portions to be combined is not limited to four, but three lens portions, or five or more lens portions may be combined. Further, the lens portions 11*a* to 11*d* are not necessarily quadrangular in front view, but they may also be triangular in front view as shown in FIG. 5. To be specific, the curvature of each light exiting surface, the number of lens portions, the shapes of lens portions, and the like can be controlled suitably in response to a desired aesthetic design.

Thus, the projection lens 11 can have a novel appearance providing a feeling of solidness, while the lens portions 11*a* to 11*d* can have the same thickness and the focal point, and have level differences between the light exiting surfaces 11*a*1 to 11*d*1, and between the light incident surfaces 11*a*2 to 11*d*2 as a result of different curvatures (see FIG. 3).

The projection lens 11 of the aforementioned structure can have a single focal point while it is formed by combining the plurality of lens portions 11*a* to 11*d*. Accordingly, the projection lens 11 can be treated in the same manner as generally used spherical or aspherical lenses.

Light Source 12

The light source 12 can be an LED light source including at least one LED chip (blue LED chip, for example) and a wavelength conversion material such as a fluorescent material (yellow fluorescent material, for example).

The light source 12 can be disposed on or near a focal point F of the projection lens 11 (see FIG. 3). The projection lens 11 can magnify an image of the light source 12 and project the magnified image, thereby forming a light distribution for the headlamp.

The light exiting surfaces 11*a*1 to 11*d*1 of the projection lens 11 can have comparatively large curvatures. Accordingly, a structure inside the projection lens 11 would be recognized in a magnified manner if viewed through the projection lens 11, generating a fear of deterioration in the appearance. In order to avoid this, it may be desirable in certain applications that a reflection surface 13 be provided on the same side as the light incident surface of the projection lens 11 and in a region that does not make the reflection surface 13 interfere with light from the light source 12 when entering the projection lens 11. The reflection surface 13 is intended to veil any inner structure in order to enhance the appearance of the light. When subjected to a process that enhances brightness (such as sputtering with aluminum), the reflection surface 13 can be recognized in a magnified manner through the projection lens 11, allowing the vehicle light 10 to have an appearance that provides a feeling of solidness. The reflection surface 13 can be located in a region that does not make the reflection surface 13 cut off light from entering the projection lens 11, exerting little or no effect on the light distribution. By coloring the reflection surface 13, the appearance observed when the light source 12 does not emit light can be changed irrespective of the color of emitted light.

Modifications will now be described below.

First Modification

Figure 6A:
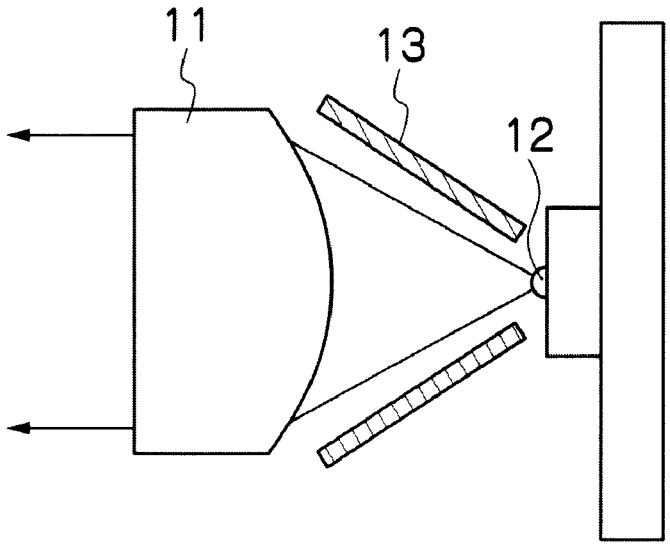
FIG. 6A is a vertical cross-sectional view of a vehicle light of a type called a direct projection light formed by using a projection lens.
Figure 6B:
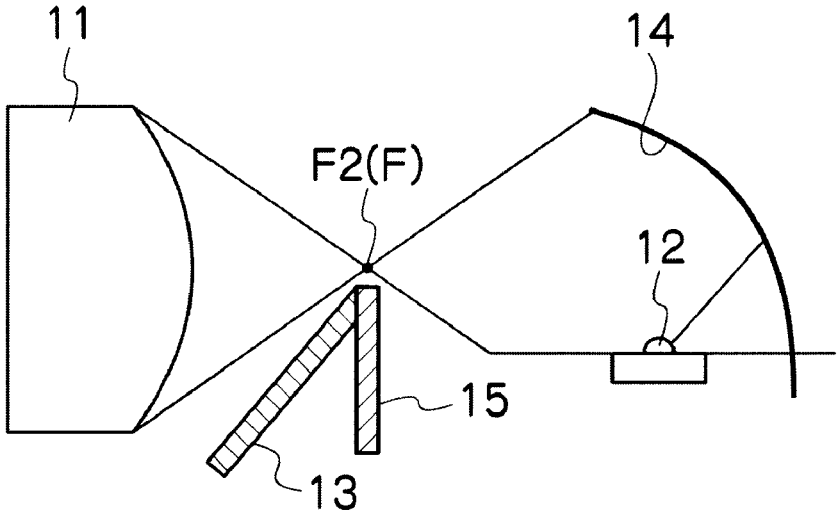
FIG. 6B is a vertical cross-sectional view of a vehicle light of a type called a projection light formed by using the projection lens.

A projection type vehicle light shown in FIG. 6B may be formed. This vehicle light can be formed by placing the light source 12 on or near (i.e., substantially at) a first focal point F1 of an ellipsoidal reflection surface 14, placing the focal point F of the projection lens 11 of the aforementioned structure on or near a second focal point F2 of the reflection surface 14, and placing a shade 15 between the projection lens 11 and the light source 12 while placing the upper edge of the shade 15 on or near the second focal point F2.

In this case, it may also be desirable to provide the reflection surface 13 in order to veil the inner structure (such as the shade 15) on the same side as the light incident surface of the projection lens 11 and in a region that does not make the reflection surface 13 interfere with light from the light source 12 to enter the projection lens 11, thereby subjectively enhancing the appearance of the projection lens 11.

Second Modification

In the first exemplary embodiment described above, the vehicle light 10 is shown to be a headlamp, to which the presently disclosed subject matter is not intended to be limited. The vehicle light of the first exemplary embodiment is also applicable to an automobile illumination lamp such as a fog lamp, and to an automobile signal lamp such as a tail lamp, a stop lamp, a turn signal lamp, a daytime running lamp, and a position lamp, and possibly other types of lamps.

Second Exemplary Embodiment

A vehicle light of a second exemplary embodiment will be described below with reference to the drawings.

Figure 7:
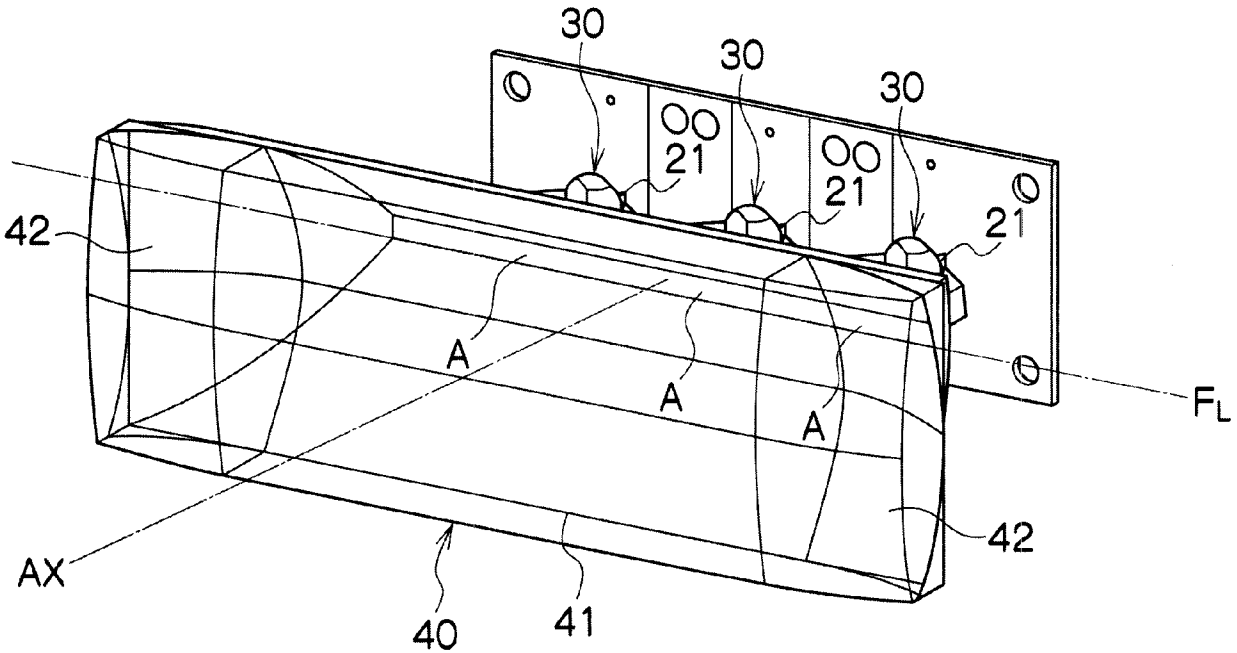
FIG. 7 is a perspective view of a vehicle light (fog lamp) of a second exemplary embodiment made in accordance with principles of the presently disclosed subject matter.

The vehicle light of the second exemplary embodiment can be a fog lamp that can be disposed at each of right and left sides of the front end of a vehicle. The fog lamp 20 on the right side and the fog lamp 20 on the left side arranged in a symmetric manner can have the same structure. Accordingly, the description given below is directed mainly to the fog lamp 20 on the left side. FIG. 7 is a perspective view of the fog lamp 20 arranged on the left side.

As shown in FIG. 7, the vehicle light 20 of the second exemplary embodiment can include light sources 21, lens bodies 30, a projection lens 40, and other structures.

LED Light Source 21

As an example, the LED light sources 21 can be a surface light source with a light source package on which a plurality of (for example, blue) light emitting chips are mounted, and a (for example, yellow) fluorescent material applied on or fixedly disposed on the light source package and which can emit light by being excited with the emission wavelengths of the light emitting chips. The second exemplary embodiment utilizes a chip-type LED light source providing little or no directional characteristics to the intensity of light emission, as one example.

Lens Body 30

Figure 8:
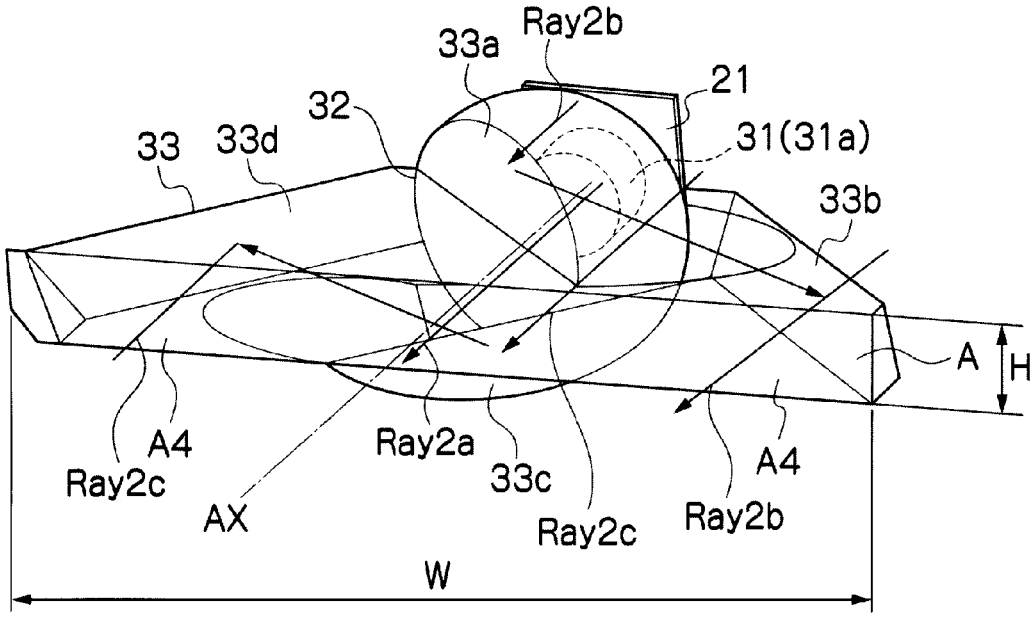
FIG. 8 is a perspective view of a lens body made in accordance with principles of the presently disclosed subject matter.
Figure 9:
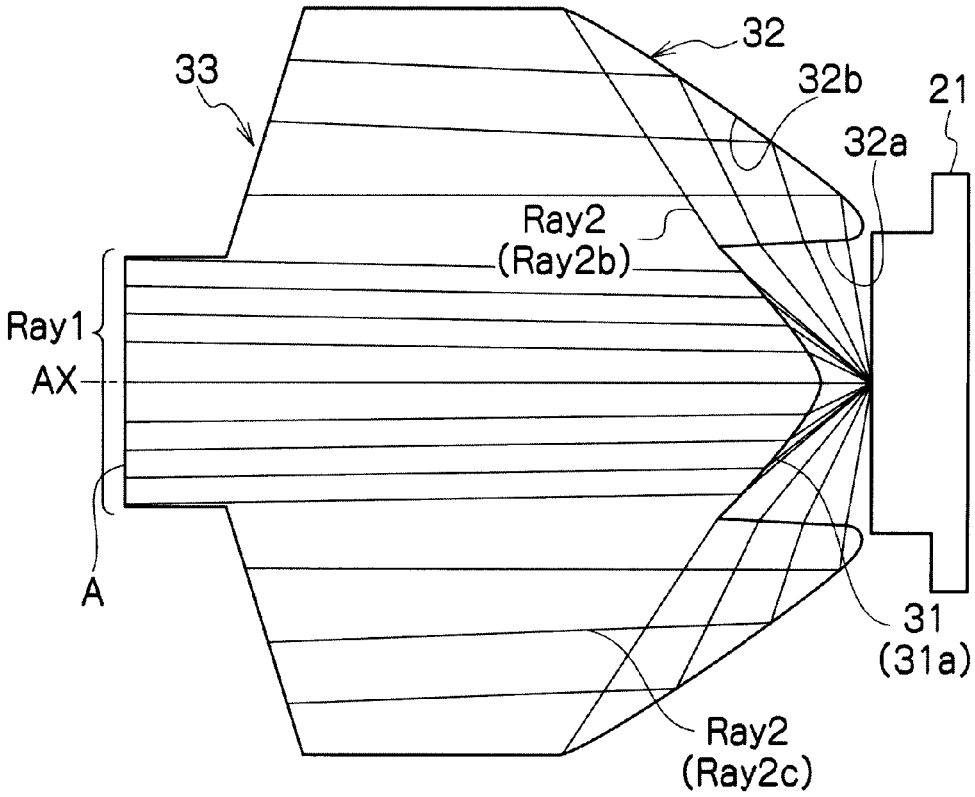
FIG. 9 is a vertical cross-sectional view of the lens body made in accordance with principles of the presently disclosed subject matter.

As shown in FIGS. 8 and 9, the lens bodies 30 can each include lens portions (first, second and third lens portions 31, 32 and 33) for converting the LED light source 21 to a linear light emitting part. The lens portions 31 to 33 can be formed integrally by injection molding of a transparent resin such as an acrylic resin or a polycarbonate resin.

First Lens Portion 31

As shown in FIGS. 8 and 9, the first lens portion 31 can be disposed in front of the LED light source 21 and on an optical axis AX of the lens body 30.

The first lens portion 31 can collect rays of light Ray1 which are part of light emitted from the LED light source 21 and which are to travel in a narrow angle direction with respect to the optical axis AX, and can convert the collected rays of light Ray1 to rays of light parallel to the optical axis AX. The first lens portion 31 can include a first light incident surface 31*a*.

The first light incident surface 31*a* can be disposed in front of the LED light source 21 and on the optical axis AX in order for the rays of light Ray1 which are part of light emitted from the LED light source 21 and which are to travel in a narrow angle direction with respect to the optical axis AX to enter the first light incident surface 31*a*.

The first light incident surface 31*a* can be formed as a convex lens surface (of a lens diameter ϕ of 3 mm, for example) having a convex surface facing the LED light source 21 (see FIG. 9), thereby collecting the rays of light Ray1 which are part of light emitted from the LED light source 21 and which are to travel in a narrow angle direction with respect to the optical axis AX, and converting the collected rays of light Ray1 to rays of light parallel to the optical axis AX.

As shown in FIG. 9, the first lens portion 31 of the aforementioned structure can refract the rays of light Ray1 at the first light incident surface 31*a* which are part of light emitted from the LED light source 21 and which are to travel in a narrow angle direction with respect to the optical axis AX. Then, the first lens portion 31 can cause the refracted rays of light Ray1 to enter the first lens portion 31, collect the rays of light Ray1, and convert the collected rays of light Ray1 to rays of light parallel to the optical axis AX (parallel rays of light within a circular region A1 in front view, see FIG. 10). The converted rays of light Ray1 can travel in the first lens portion 31 (see FIG. 9).

Second Lens Portion 32

As shown in FIGS. 8 and 9, the second lens portion 32 can be disposed outside the first lens portion 31.

The second lens portion 32 can be a lens portion (of a lens diameter ϕ of 9 mm, for example) for collecting rays of light which are part of light emitted from the LED light source 21 and which are to travel in a wide angle direction with respect to the optical axis AX (namely, rays of light to travel outwardly of the first lens portion 31 without entering the first lens portion 31, see reference number Ray2 of FIG. 9), and converting the collected rays of light to rays of light parallel to the optical axis AX. The second lens portion 32 can include a second light incident surface 32*a* and a total reflection surface 32*b*.

The second light incident surface 32*a* can be formed as a lens surface in the shape of an upright wall (in the shape of a cylinder) extending from the periphery of the first light incident surface 31*a* toward the LED light source 21. This can cause the rays of light Ray2 which are part of light emitted from the LED light source 21 and which are to travel in a wide angle direction with respect to the optical axis AX to enter the second light incident surface 32*a*.

The total reflection surface 32*b* can be disposed outside the second light incident surface 32*a* in order for the rays of light Ray2 having entered the second lens portion 32 after being refracted at the second light incident surface 32*a* to enter the total reflection surface 32*b*.

The total reflection surface 32*b* can be formed as a reflection surface of a revolved paraboloid and the focal point of which is set at an intersecting point (not shown) of extended lines of the rays of light Ray2 in a group from the LED light source 21 having entered the second lens portion 32 after being refracted at the second light incident surface 32*a*.

Accordingly, the total reflection surface 32*b* can cause the rays of light Ray2 from the LED light source 21 having entered the second lens portion 32 after being refracted at the second light incident surface 32*a* to reflect totally, collect the reflecting rays of light Ray2, and convert the collected rays of light Ray2 to rays of light parallel to the optical axis AX.

As shown in FIG. 9, the second lens portion 32 of the aforementioned structure can refract the rays of light Ray2 which are part of light emitted from the LED light source 21 and which are to travel in a wide angle direction with respect to the optical axis AX at the second light incident surface 32*a*, and cause the refracted rays of light Ray2 to enter the second lens portion 32. Then, the rays of light Ray2 can be collected and converted by the total reflection surface 32*b* to rays of light parallel to the optical axis AX (parallel rays of light within a circular region A2 in front view, see FIG. 10). The converted rays of light Ray2 can travel in the second lens portion 32 (see FIG. 9).

Third Lens Portion 33

Figure 10:
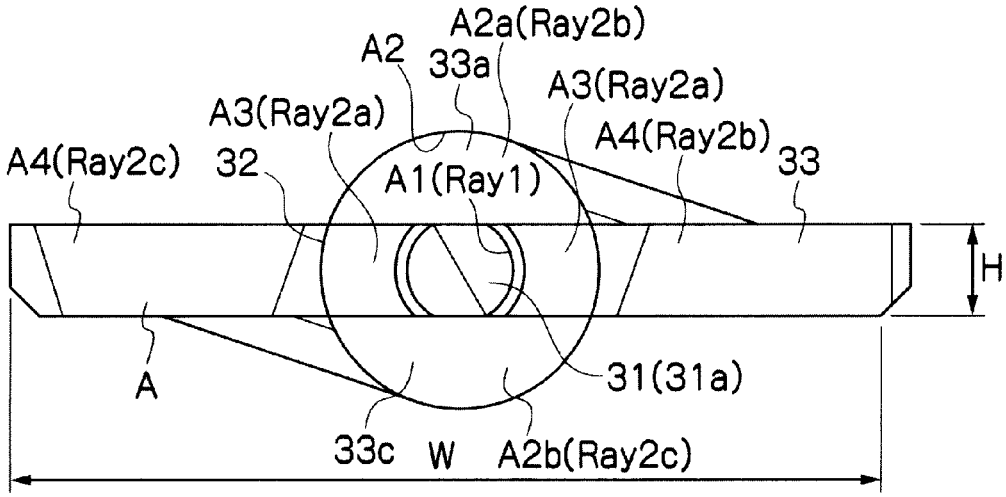
FIG. 10 is a front view of the lens body as viewed from a rectangular light exiting surface A thereof.
Figures 11A, 11B, 11C:
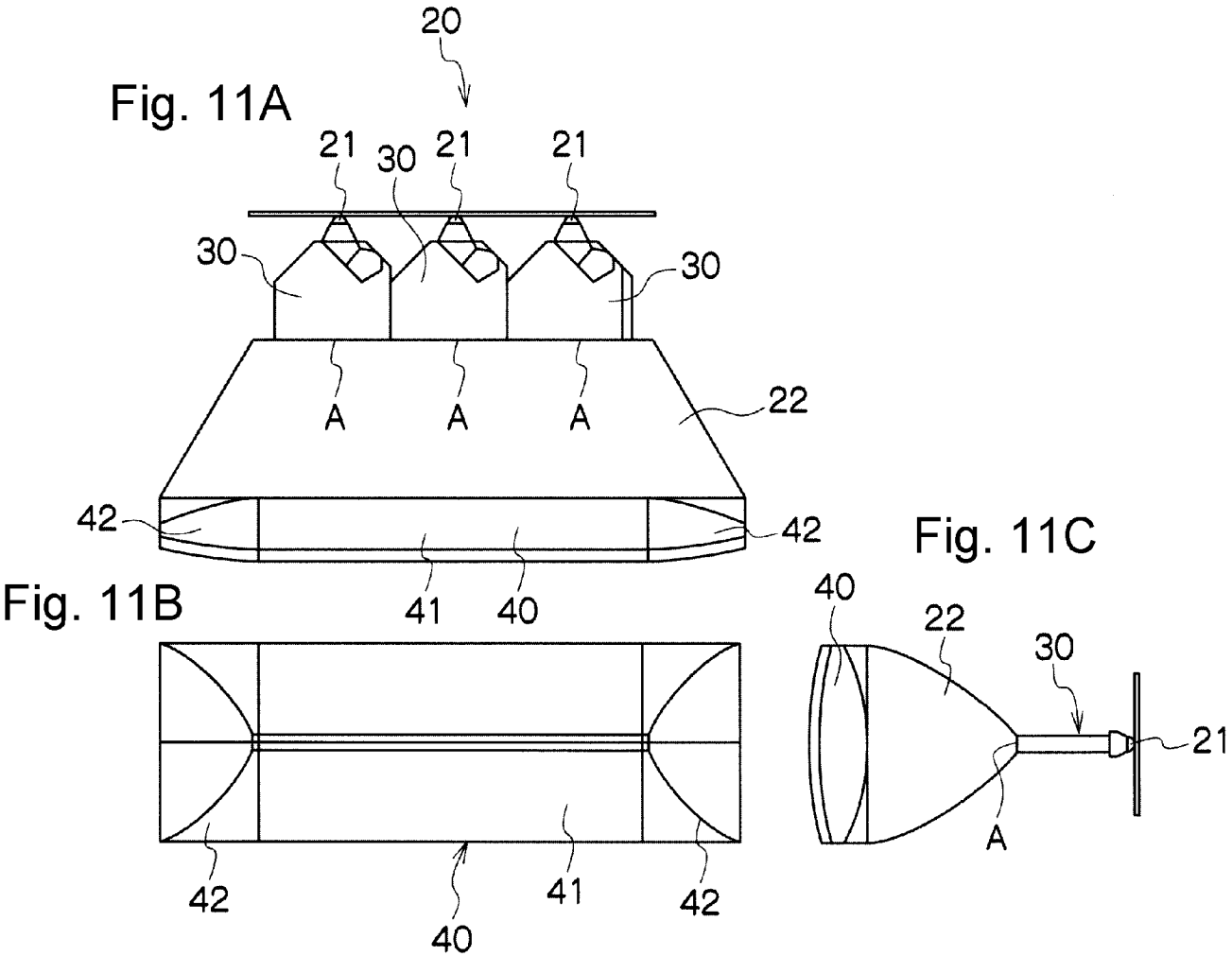
FIGS. 11A, 11B and 11C are a top view, a front view, and a side view of the vehicle light (fog lamp), respectively.

As shown in FIGS. 8 and 9, the third lens portion 33 can be disposed in front of the first and second lens portions 31 and 32 in order for the rays of light Ray1 and Ray2 traveling in the first and second lens portions 31 and 32 respectively and parallel to the optical axis AX (parallel rays of light within the circular region A1, and parallel rays of light within the circular region A2 outside the circular region A1, see FIG. 10) to enter the third lens portion 33.

As shown in FIGS. 8 and 10, the third lens portion 33 can include a rectangular light exiting surface A (edge surface perpendicular to the optical axis Ax) having a height H (3 mm, for example) substantially the same as the diameter of the first lens portion 31, and a width W (27 mm, for example) greater than the diameter of the second lens portion 32.

The rectangular light exiting surface A can be disposed on the optical axis AX such that the rays of light Ray1 traveling in the first lens portion 31 can pass through the circular region A1 at the center of the rectangular light exiting surface A (see FIG. 10).

As shown in FIG. 10, the rectangular light exiting surface A can extend in one direction if viewed as a whole. The rectangular light exiting surface A can include the central region A1 through which the rays of light Ray1 pass which are collected by the first lens portion 31 and traveling in the first lens portion 31, two first regions A3 on the opposite sides of the central region A1 and through which a ray of light Ray2*a* passes which is part of the rays of light Ray2 collected by the second lens portion 32 and traveling in the second lens portion 32, and two second regions A4 on the outer side of the two first regions A3.

A ray of light Ray2*b* and a ray of light Ray2*c* which are part of the rays of light Ray2 traveling in the second lens portion 32 and which are not to pass through the rectangular light exiting surface A are to travel toward a semicircular region A2*a* outside one of the long sides of the rectangular light exiting surface A, and toward a semicircular region A2*b* outside the other of the long sides of the rectangular light exiting surface A respectively in front view (see FIG. 10).

In order to change the routes of the rays of light Ray2*b* and Ray2*c* traveling toward the semicircular regions A2*a* and A2*b* respectively outside the rectangular light exiting surface A and to cause the rays of light Ray2*b* and Ray2*c* to pass through the second regions A4 of the rectangular light exiting surface A, the third lens portion 33 can include a structure including first and second total reflection surfaces 33*a* and 33*b* for changing the route of the ray of light Ray2*b*, and a structure including third and fourth total reflection surfaces 33*c* and 33*d* for changing the route of the ray of light Ray2*c*.

In order for the ray of light Ray2*b*, which is part of the rays of light Ray2 collected by the second lens portion 32 and traveling in the second lens portion 32 and which is to travel toward a region outside one of the long sides of the rectangular light exiting surface A (upper semicircular region A2*a* of FIG. 10), to enter the first total reflection surface 33*a*, the first total reflection surface 33*a* can be disposed in a direction in which the ray of light Ray2*b* is to travel.

The first total reflection surface 33*a* can be disposed in a posture tilted about 45 degrees with respect to the optical axis AX (see FIG. 8) in order for the ray of light Ray2*b* having entered the first total reflection surface 33*a* to reflect sideways (to the right of FIG. 8).

The second total reflection surface 33*b* can be disposed in a posture tilted about 45 degrees with respect to the optical axis AX (see FIG. 8), and on the right-hand side of FIG. 8 and at the same height as one of the second regions A4 (second region A4 on the right side of FIG. 10). This causes the ray of light Ray2*b* after reflecting off the first total reflection surface 33*a* to enter the second total reflection surface 33*b*, and causes the ray of light Ray2*b* having entered the second total reflection surface 33*b* to reflect in a direction parallel to the optical axis AX to pass through one of the second regions A4 (second region A4 on the right side of FIG. 10) of the rectangular light exiting surface A.

In order for the ray of light Ray2*c*, which is part of the rays of light Ray2 collected by the second lens portion 32 and traveling in the second lens portion 32 and which is to travel toward a region outside the other of the long sides of the rectangular light exiting surface A (lower semicircular region A2*b* of FIG. 10), to enter the third total reflection surface 33*c*, the third total reflection surface 33*c* can be disposed in a direction in which the ray of light Ray2*c* is to travel.

The third total reflection surface 33*c* can be disposed in a posture tilted about 45 degrees with respect to the optical axis AX (see FIG. 8) in order for the ray of light Ray2*c* having entered the third total reflection surface 33*c* to reflect sideways (to the left of FIG. 8).

The fourth total reflection surface 33*d* can be disposed in a posture tilted about 45 degrees with respect to the optical axis AX (see FIG. 8), and on the left-hand side of FIG. 8 and at the same height as the other of the second regions A4 (second region A4 on the left side of FIG. 10). This causes the ray of light Ray2*c* after reflecting off the third total reflection surface 33*c* to enter the fourth total reflection surface 33*d*, and causes the ray of light Ray2*c* having entered the fourth total reflection surface 33*d* to reflect in a direction parallel to the optical axis AX to pass through the other of the second regions A4 (second region A4 on the left side of FIG. 10) of the rectangular light exiting surface A.

The first to fourth total reflection surfaces 33*a* to 33*d* may be total reflection surfaces of a planar shape.

The aforementioned structures of the LED light source 21, and the first to third lens portions 31 to 33 allow the first lens portion 31, the second lens portion 32, and the first to fourth total reflection surfaces 33*a* to 33*d* to convert the LED light source 21 to a linear light emitting part (linear light emitting part formed by causing the collected rays of light Ray1 and Ray2*a* to Ray2*c* traveling in directions parallel to the optical axis AX to pass through the substantially entire region of the rectangular light exiting surface A). Assuming that the aspect ratio of the size of light emission at the central circular region A1 is 1:1, the LED light source 21 can be converted to a linear light emitting part having an aspect ratio of about 1:9, for example.

The aforementioned structures of the LED light source 21, and the first to third lens portions 31 to 33 also allow the second lens portion 32 to make use of the rays of light Ray2 which are part of light emitted from the LED light source 21 and which are to travel in a wide angle direction with respect to the optical axis AX. This makes it possible to enhance efficiency of use of light to a level higher than a conventional level.

Also, unlike a conventional structure using a mirror processed by sputtering and the like, the aforementioned structures of the LED light source 21, and the first to third lens portions 31 to 33 can use the first to fourth total reflection surfaces 33*a* to 33*d* that cause the rays of light Ray2*b* and Ray2*c* traveling in the lens to reflect internally (totally) twice. This makes it possible to enhance efficiency of use of light to a level still higher than the conventional level.

The aforementioned structures of the LED light source 21, and the first to third lens portions 31 to 33 still allow the first lens portion 31, the second lens portion 32, and the first to fourth total reflection surfaces 33*a* to 33*d* to convert rays of light emitted from the LED light source 21 to the collected rays of light Ray1, and Ray2*a* to Ray2*c* traveling in directions parallel to the optical axis AX to pass through the substantially entire region of the rectangular light exiting surface A (easy-to-control rays of light traveling in the same direction that are hereinafter called rays of light Ray3).

Projection Lens 40

The projection lens 40 can be made of a transparent resin such as an acrylic resin or glass. As shown in FIG. 7, and FIGS. 11A to 11C, the projection lens 40 can include a cylindrical lens 41, and lens portions 42 (corresponding to a first lens portion and a second lens portion of the presently disclosed subject matter) disposed at opposite ends of the cylindrical lens 41 extending in the direction of the cylindrical axis of the cylindrical lens 41. The projection lens 40 may correspond to a lens formed by cutting a lens portion in the form of a quadrangle in front view out of a spherical convex lens of a relatively large curvature, dividing the lens portion into right and left lens portions with respect to the optical axis thereof, and placing the cylindrical lens 41 between the right and left lens portions. The curvature of the cylindrical lens 41 (curvature of the light exiting surface thereof) can be the same (or substantially the same) as the curvature of the lens portions 42 (curvature of the light exiting surfaces thereof).

As shown in FIG. 7, three optical systems each including the light source 21 and the lens body 30 can be arranged in the horizontal direction, thereby forming a linear light source with the three rectangular light exiting surfaces A successively disposed in the horizontal direction.

The linear light source (three rectangular light exiting surfaces A successively disposed in the horizontal direction) can be arranged to extend along a focal line FL of the projection lens 40 (see FIG. 7). The projection lens 40 can magnify an image of the linear light source (three rectangular light exiting surfaces A successively disposed in the horizontal direction) and projects the magnified image, thereby forming light distribution of for the fog lamp.

An automobile signal lamp (such as a fog lamp) may be required to provide an area of light emission of 50 square centimeters or larger under laws and/or regulations. Meanwhile, the linear light source of the aforementioned structure can provide an area of light emission corresponding to a total of the areas of the three rectangular light exiting surfaces A (each having a height H of 3 mm and a width W of 27 mm). Accordingly, there will be shortage of an area of light emission if more optical systems each including the light source 21 and the lens body 30 are not prepared.

However, in the fog lamp 20 of the second exemplary embodiment, the linear light source (three rectangular light exiting surfaces A successively disposed in the horizontal direction) can be magnified by the projection lens 40 of the aforementioned structure. This makes it possible to maintain an area of light emission of 50 square centimeters or larger without the need of preparing more optical systems each including the light source 21 and the lens body 30. Further, rays of light to travel toward the opposite ends of the cylindrical lens 41 extending in the direction of the cylindrical axis thereof can be controlled by the lens portions 42.

The light exiting surface of the projection lens 40 can have a comparatively large curvature. Accordingly, a structure inside the projection lens 40 would be recognized in a magnified manner if viewed through the projection lens 40, generating a fear of deterioration of the appearance. In order to avoid this, it may be desirable that a reflection surface 22 be provided on the same side as the light incident surface of the projection lens 40 and in a region that does not make the reflection surface 22 interfere with light from the linear light source (three rectangular light exiting surfaces A successively disposed in the horizontal direction) to enter the projection lens 40. The reflection surface 22 is intended to veil the inner structure to subjectively enhance the appearance. When subjected to a process to enhance brightness (such as sputtering with aluminum), the reflection surface 22 can be recognized in a magnified manner through the projection lens 40, allowing the vehicle light 20 to have an appearance that provides a feeling of solidness. The reflection surface 22 can be arranged in a region that does not make the reflection surface 22 cut off light that enters the projection lens 40, exerting little or no effect on distribution of light. By coloring the reflection surface 22, the appearance observed while the linear light source does not emit light can be changed irrespective of the color of emitted light.

Modifications will be described below.

Third Modification

Figure 12:
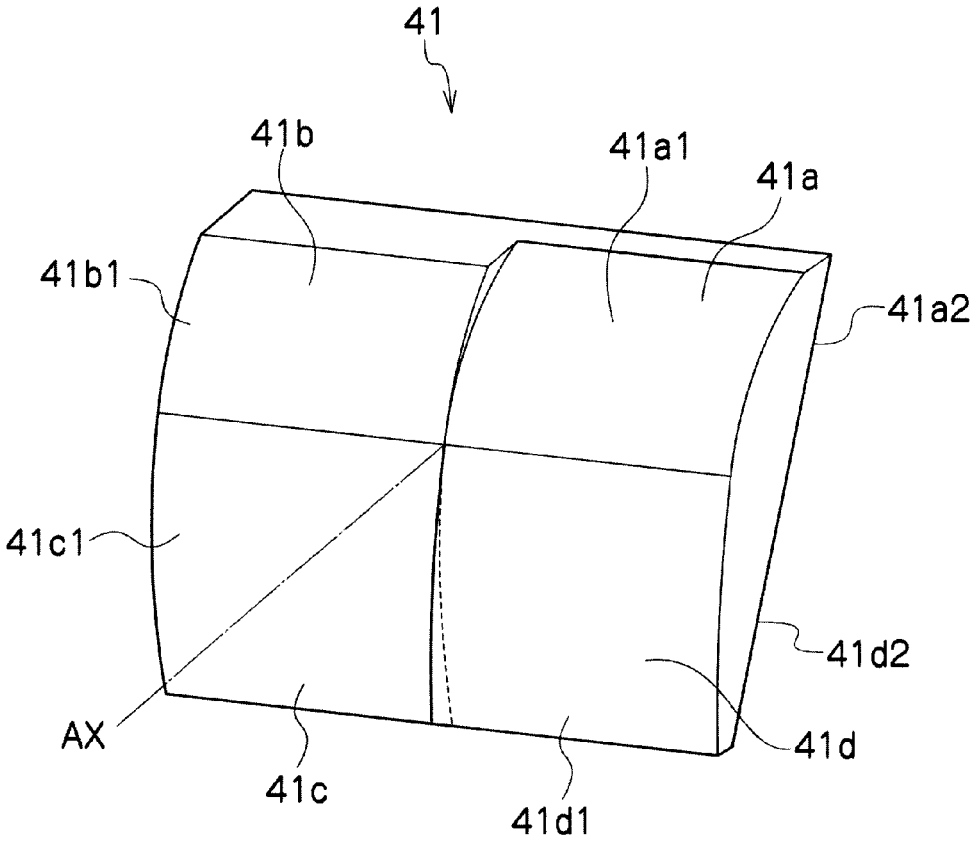
FIG. 12 is a modification of a cylindrical lens made in accordance with principles of the presently disclosed subject matter.

Like that of the first exemplary embodiment, a cylindrical lens 41 of a third modification can include four cylindrical lens portions 41*a* to 41*d* obtained by dividing the cylindrical lens 41 in a radial pattern with respect to the optical axis AX of the cylindrical lens 41 as shown in FIG. 12. The cylindrical lens portions 41*a* to 41*d* can have light exiting surfaces 41*a*1 to 41*d*1 having different curvatures. The cylindrical lens portions 41*a* to 41*d* can also have light incident surfaces 41*a*2 to 41*d*2 the shapes of which can be determined such that the cylindrical lens portions 41*a* to 41*d* have the same focal line.

The projection lens 40 may be formed in the following exemplary manner. Four cylindrical lenses can be prepared so as to have light exiting surfaces 41*a*1 to 41*d*1 of different curvatures (expressed as R50, R70, R100 and R200, for example), and light incident surfaces 41*a*2 to 41*d*2 the shapes of which are determined such that the four cylindrical lenses have the same thickness and the same focal line. Then, four cylindrical lens portions 41*a* to 41*d* are cut out of the four cylindrical lenses with respect to respective optical axes of the lenses to be shaped into quadrangles in front view, and the cut out cylindrical lens portions 41*a* to 41*d* are combined, thereby forming the projection lens 40.

The number of cylindrical lens portions to be combined is not limited to four, but may be three cylindrical lens portions, or five or more cylindrical lens portions may be combined. Further, cylindrical lens portions are not necessarily quadrangular in front view, but they may also be triangular in front view. To be specific, the curvature of each light exiting surface, the number of cylindrical lens portions, the shapes of cylindrical lens portions, and the like can be controlled suitably in response to a desired aesthetic design.

Thus, the projection lens 40 can have a novel appearance providing a feeling of solidness with the same thickness and the same focal line, and with level differences between the light exiting surfaces 41*a*1 to 41*d*1, and between the light incident surfaces 41*a*2 to 41*d*2 as a result of different curvatures.

The projection lens 40 of the aforementioned structure can have a single focal line FL while it is formed by combining the plurality of cylindrical lens portions 41*a* to 41*d*. Accordingly, the projection lens 40 can be treated in the same manner as generally used cylindrical lenses.

Fourth Modification

In the second exemplary embodiment described above, the vehicle light 20 is shown to be a fog lamp, to which the presently disclosed subject matter is not intended to be limited. The vehicle light of the second exemplary embodiment is also applicable to an automobile illumination lamp such as a headlamp, and to an automobile signal lamp such as a tail lamp, a stop lamp, a turn signal lamp, a daytime running lamp, and a position lamp, as well as other more general lamps.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle light including a projection lens having an optical axis, comprising:

a plurality of separate lens portions divided in a radial pattern with respect to the optical axis of the projection lens, wherein the separate lens portions have respective light exiting surfaces of different curvatures, and respective light incident surfaces, the respective light incident surfaces having shapes determined such that the separate lens portions have the same thickness and the same focal point with respect to each other.

2. The vehicle light according to claim 1, further comprising:

a reflection surface configured to veil an inner structure, and located on a same side as a light incident surface of the projection lens and in a region that does not allow the reflection surface to interfere with light entering the projection lens from a light source for the vehicle light.

3. A vehicle light including a cylindrical lens having an optical axis, comprising:

a plurality of separate cylindrical lens portions divided in a radial pattern with respect to the optical axis of the cylindrical lens, wherein the separate cylindrical lens portions have respective light exiting surfaces of different curvatures, and respective light incident surfaces, the respective light incident surfaces having shapes determined such that the separate cylindrical lens portions have the same thickness and the same focal line with respect to each other.

4. The vehicle light according to claim 3, wherein the cylindrical lens includes a first lens portion disposed at one end of the cylindrical lens extending along a cylindrical axis of the cylindrical lens, and a second lens portion disposed at an opposite end of the cylindrical lens extending along the cylindrical axis.

5. The vehicle light according to claim 4, wherein the first and second lens portions are lens portions corresponding to two lens portions obtained by dividing a lens portion in the form of a quadrangle in front view cut out of a spherical convex lens into two with respect to an optical axis of the cut out lens portion.

6. The vehicle light according to claim 5, further comprising:

a reflection surface configured to veil an inner structure, and located on a same side as a light incident surface of the cylindrical lens and in a region that does not allow the reflection surface to interfere with light entering the cylindrical lens from a light source for the vehicle light.

7. The vehicle light according to claim 4, further comprising:

a reflection surface configured to veil an inner structure, and located on a same side as a light incident surface of the cylindrical lens and in a region that does not allow the reflection surface to interfere with light entering the cylindrical lens from a light source for the vehicle light.

8. The vehicle light according to claim 3, further comprising:

a reflection surface configured to veil an inner structure, and located on a same side as a light incident surface of the cylindrical lens and in a region that does not allow the reflection surface to interfere with light entering the cylindrical lens from a light source for the vehicle light.

* * * * *